United States Patent [19]

Perazzo

[11] Patent Number: 4,715,412

[45] Date of Patent: Dec. 29, 1987

[54] METHOD AND APPARATUS FOR CHECK-WEIGHING CHARGES FOR CONTAINERS

[75] Inventor: Nicholas J. Perazzo, Green Bay, Wis.

[73] Assignee: Bemis Company, Inc., Minneapolis, Minn.

[21] Appl. No.: 768,205

[22] Filed: Aug. 22, 1985

[51] Int. Cl.[4] ..... B65B 1/32; B65B 1/28

[52] U.S. Cl. ..... 141/1; 141/98; 141/129; 141/180; 177/55

[58] Field of Search ..... 141/83, 140, 180, 1, 141/198; 177/54, 55

[56] References Cited

U.S. PATENT DOCUMENTS

| | | | |
|---|---|---|---|
| 3,024,816 | 3/1962 | Axlid et al. | 141/83 |
| 3,073,400 | 1/1963 | Bauder et al. | 177/56 |
| 3,333,648 | 8/1967 | Dodd | 177/55 |
| 3,368,593 | 2/1968 | Mamas | 141/83 |
| 3,404,742 | 10/1968 | Bonneric | 177/59 |
| 3,557,847 | 7/1971 | Hebel | 141/54 |
| 3,654,970 | 4/1972 | Teboul | 141/284 |
| 4,092,721 | 5/1978 | Rueff et al. | 364/479 |
| 4,275,775 | 6/1981 | Egli | 141/83 |

*Primary Examiner*—Stephen Marcus
*Assistant Examiner*—Mark Thronson
*Attorney, Agent, or Firm*—Senniger, Powers, Leavitt and Roedel

[57] ABSTRACT

Method and apparatus for check-weighing a product charge in a continuously operating conveyor system without interrupting the operation and without having extra empty containers in the system after a check-weigh has occurred. Containers are fed forward in a series to a filling station where they are filled with a measured charge of product. When a check-weigh is desired a container is prevented from entering the series, a gap occurs corresponding to the measured charge to be check-weighed, and that charge is diverted to a scale and weighed while subsequent containers receive their charges uninterrupedly.

15 Claims, 14 Drawing Figures

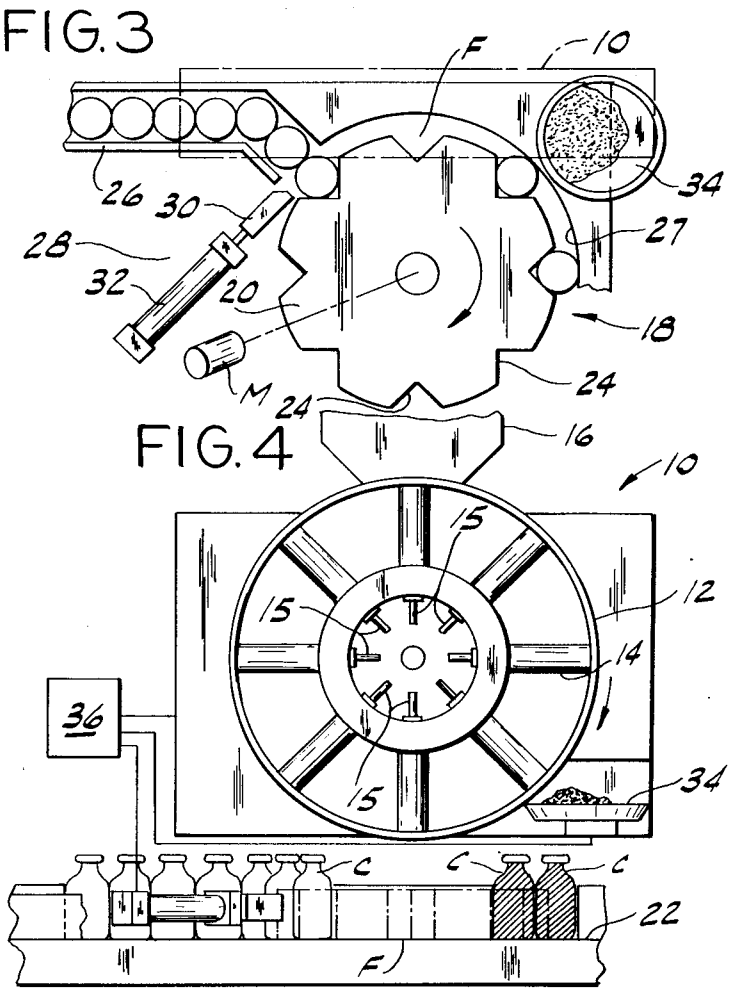
FIG. 3
FIG. 4
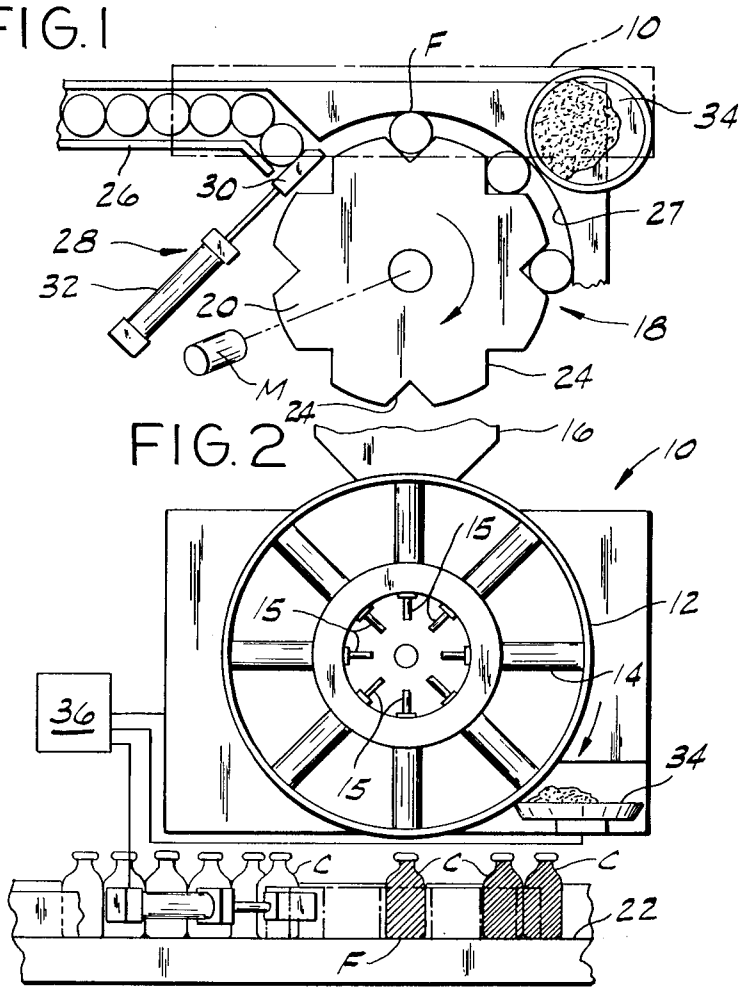
FIG. 1
FIG. 2

METHOD AND APPARATUS FOR CHECK-WEIGHING CHARGES FOR CONTAINERS

FIELD OF THE INVENTION

The present invention relates to check-weighing apparatus and, more particularly, to an automatic check-weighing apparatus for use in a continuous operation for filling containers.

BACKGROUND OF THE INVENTION

It is often desirable in continuously filling large numbers of containers in a commercial assembly line environment to check the weight of a charge of material that would be deposited in a container, in order to observe whether or not the filling device is actually placing the desired charge weight in the containers being filled.

In the past, this check-weighing has been accomplished in several different ways. One way is to take the gross weight minus the average tared weight. This method is used where the tared weight of each package is approximately the same and the net weight is usually considerably heavier than the tared weight. When these conditions exist, weighing the product and the container together is the simplest and most accurate method of check-weighing. However, as the net weight becomes close to the tared weight, the accuracies of this system begin to fail as discrepancies in tared weights will be reflected as discrepancies in the net weight.

A further way is to take the gross weight minus the specific tared weight. This method is used where the tared weight can vary considerably from container to container and the tared weight is close to or greater than the net weight. In this situation, a sample container is weighed before product is filled into the container and this specific container is again weighed after filling and the difference between the weights is said to be the net weight. This system has a distinct disadvantage, particularly when the tared weight is far in excess of the net weight. In this situation, small inaccuracies in the weighing of the container can be reflected as large variations in the net weight. This method also has the disadvantage that in production situations it is difficult to insert tared containers into and remove them from the production line after being filled without disrupting production. An example of this method of check-weighing is found in the pharmaceutical industry where as little as one gram of product may be filled into a container weighing 100 grams.

Yet another way is direct net weigh. In this method, the product is poured or knocked out of the container onto a pan of the scale or the filled container is weighed and the product is knocked out as waste and the empty container re-weighed. The net weight is then the difference between the two weighings. All of the above methods have the disadvantage of being time consuming, they usually result in the destruction of the container and are inaccurate to the extent that all of the material may not be dispensed from the container.

SUMMARY OF THE INVENTION

The above disadvantages and problems associated with the prior art methods and apparatus are overcome by the present invention in which a check-weigh system is provided which checks the actual load that would have been provided to the container, the container need not be removed from the production line to be tared then re-inserted in the line and refilled and then again removed from the line and re-weighed, and achieves these desirable results at line speed without the assistance of inspection personnel on each check-weighing.

This is accomplished by a method of filling containers with measured charges of product in which containers are fed forward in a series one after another through a filling zone for being filled with measured charges of product as they travel through the filling zone, with gaps at spaced intervals in the series where a container is omitted, measuring charges of product including charges for the containers traveling through the filling zone and charges corresponding to the gaps, delivering to the filling zone the charges for the containers traveling through the filling zone and filling each container with a charge as it travels through the zone, diverting from the filling zone each charge corresponding to a gap and redelivering it to a check-weighing station and comparring its weight with a reference weight to determine its acceptability, whereby, upon check-weighing of a diverted charge of unacceptable weight, containers filled since the last acceptable diverted checkweighed charge may be retrieved.

In another aspect, the advantagous method of the present invention of filling containers with measured charges of product and check-weighing the filling includes feeding containers forward in a series one after another through a filling zone for being filled with measured charges of product as they travel through the filling zone, measuring charges of product and delivering them to the filling zone one after another in timed relation to the feeding of the containers, diverting a charge from being delivered to the filling zone and delivering it to a check-weighing station for being checkweighed, at intervals in the delivery of the charges, controlling the series of containers to have gaps therein corresponding to the diverted charges, whereby, there is no unfilled container in the series traveling downstream from the filling zone and, upon check-weighing of a diverted charge of unacceptable weight, containers filled since the last acceptable diverted check-weighed charge may be retrieved.

The present invention also provides apparatus for achieving the above described methods which includes conveyor means for conveying a sequential supply of containers in at least one row and in predetermined spaced relation, container filling means disposed adjacent the conveyor means for delivering a measured charge of product to each container which passes by it, product weighing means disposed adjacent the filling means for receiving therefrom a charge of product which otherwise would have been delivered to a container, and means up-stream of the filling means for creating a space on the conveyor at a location for a container corresponding to the charge weighed by the weighing means.

This apparatus also preferably further includes means for receiving containers from a supply thereof and positioning the containers in the predetermined relation, and means for withholding a container from the positioning means to produce a space where that container would otherwise have been positioned. Other objects and features will be in part apparent and in part pointed out hereinafter.

BRIEF DESCRIPTION OF THE DRAWINGS

FIG. 1 is a plan view of a first preferred embodiment of the apparatus of the present invention, showing means for creating a space in the conveyor means where a container would otherwise be positioned;

FIG. 2 is an elevational view of the embodiment of FIG. 1;

FIG. 3 is a further plan view of the embodiment of FIG. 1, showing a space in the conveyor means from which a container has been withheld;

FIG. 4 is a further elevational view as in FIG. 2, but showing the containers and apparatus as depicted in FIG. 3;

DETAILED DESCRIPTION OF THE PREFERRED EMBODIMENTS AND METHOD

Figure 7:
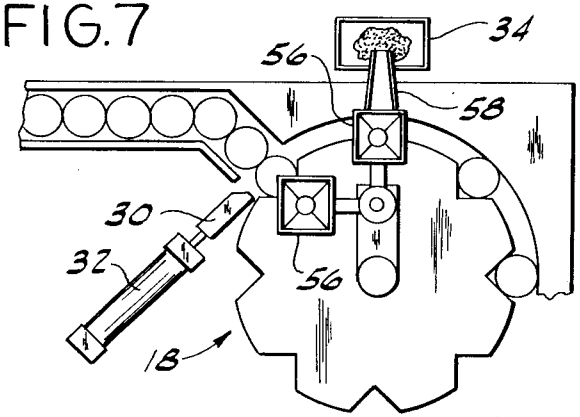
FIG. 7 is a plan view of a third alternative embodiment of the present invention.

The basic method and apparatus of the present invention involves the check-weighing of product in such a way as not to interrupt the continuous filling of containers with the product, whether the product is a solid, such as a powder, or a liquid. Containers are fed forward in a series to a filling station where they are filled with a measured charge of product. When a check-weigh is desired, a container is prevented from entering the series, i.e., deleted from the series and a gap occurs corresponding to the measured charge to be check-weighed. That charge is diverted to a scale and weighed while subsequent containers receive their charges uninterruptedly. The various embodiments discussed below and shown in the drawings are variations on the basic invention and further variations are clearly possible and are contemplated to be within the scope of the present invention The embodiment shown in FIGS. 1 and 2 is designed for the check-weighing of a powder and includes a device 10 for the measuring and dispensing of powder which is of known construction, such as that disclosed in U.S. Pat. No. 3,656,518. This device generally consists of a rotary turret filling head 12 mounted for rotation about a horizontal axis and which contains a plurality of uniformly spaced radially extending tubes 14 associated with a vacuum system (not shown) which retains the powder in the tubes and selectively expels the powder by gas pressure through dose valves 15 to fill containers C as they pass below the head 12. Immediately above the head 12 is a hopper 16 which is used to fill each of the tubes 14 as they are rotated up under it. Such a hopper is disclosed generally, for example, in U.S. Pat. No. 2,540,059.

Disposed beneath the device 10 is a conveyor means 18 which is used to convey the empty containers C under the head 12 to a filling position F for filling and then transport the filled containers to a remote location for subsequent processing, such as capping. The conveyor means 18 includes a carousel member or star wheel 20 mounted for rotation about a vertical axis above a table 22 and having a plurality of notches or slots 24 defined in its periphery in which containers C are partially received. A supply chute 26 introduces a continuous supply of containers to the slots in the carousel 20 and a guide rail 27 keeps the containers in the slots and guides them under the head 12 for filling and then removal to a remote location beyond the filling position F for subsequent processing. A means 28 for preventing containers C from being introduced into the slots 24 i.e, intermittently deleting a container from the series of containers is provided in the form of a gate 30 which is slid back and forth by an air cylinder 32.

The rotation of the head 12 is coordinated with the rotation of the carousel 20 so that each tube 14 reaches its lowermost position at the same time that a respective container C reaches the filling position F beneath it so that the charge of product in each tube is discharged into a container. The coordination can be achieved by any means such as gearing or through the use of electronically controlled motors having their speed coordinated by a microprocessor or the like.

For the purpose of check-weighing in the embodiment of FIGS. 1 and 2, a check-weigh scale 34 is positioned adjacent the head 12, either before or after the filling position F, in a position where, when the powder charge is expelled from a tube 14 it will land in the scale 34. The scale 34 can be of any conventional construction such as to provide the necessary accuracy for the particular application involved and preferably provides an electronic output signal indicative of the weight on the scale. This output signal is received by a control means 36 which is used to coordinate the discharge of powder from a tube 14 into the scale 34 with the elimination of a container from a position on the conveyor means 18.

Figure 13:
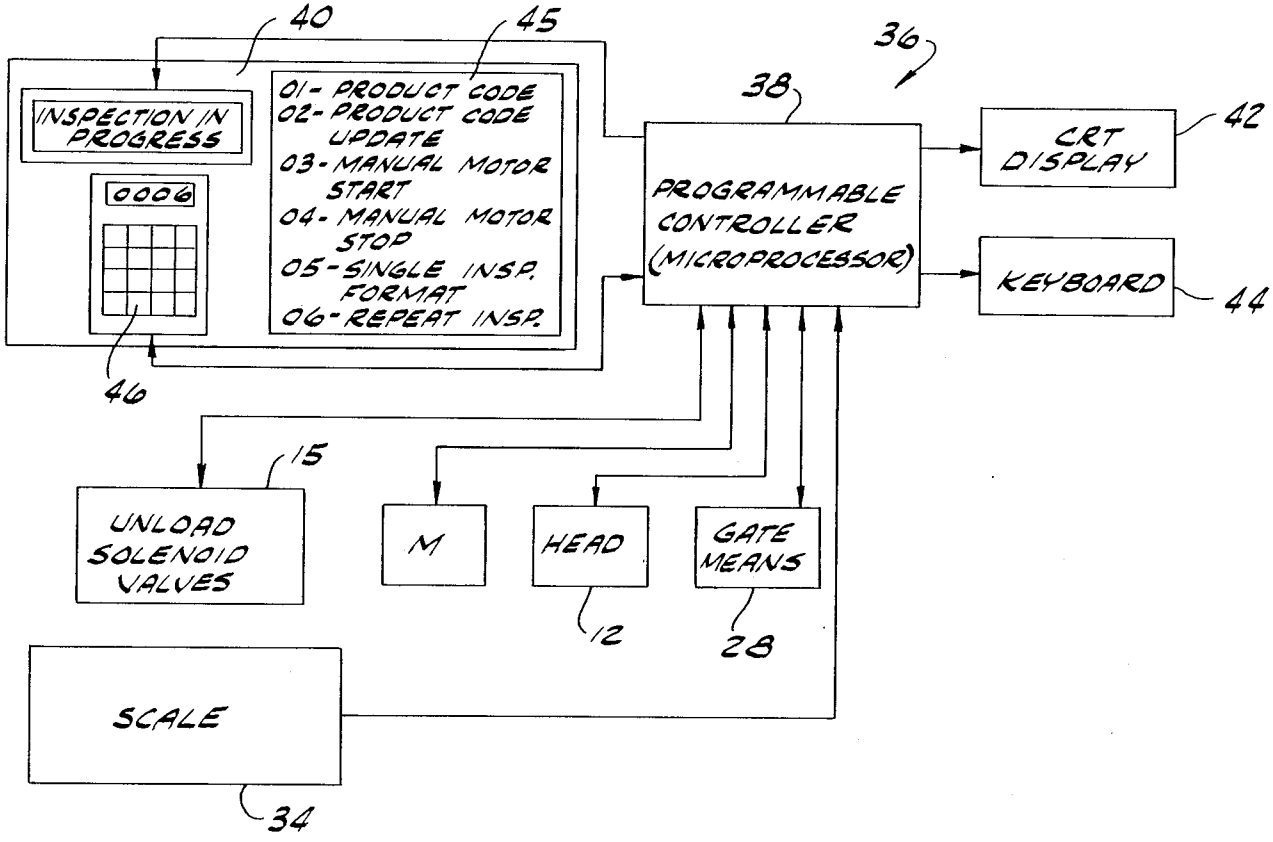
FIG. 13 is a block diagram of the control means utilized in the embodiments of the present invention.

Control means 36 is shown in more detail in FIG. 13. It basically includes a programmable controller or microprocessor 38, a mode selection panel 40, a display 42 and an input keyboard 44. The mode selection panel inputs precoded signals for desired functions of the check-weigh system as enumerated on the panel at 45. The keypad 46 has numbers on its keys corresponding to the illustrated functions so that inputting the numbers of the functions produces the desired result by action of the microprocessor. The product code and product code update codes are used to identify the output data from the control means so that the operator can trace the checkweigh results to the product being processed at the time the check-weighing took place.

The manual motor start and stop codes are input to start and stop the system. The single inspection code is used to do one inspection whenever the operator desires, and the repeat inspection code is preset to automatically check-weigh the various tubes at predetermined intervals. An "inspection in progress" light 48 is mounted in the panel 40 and is lit by signal from the microprocessor 38 when a check-weigh is being taken either manually or automatically.

Figure 14:
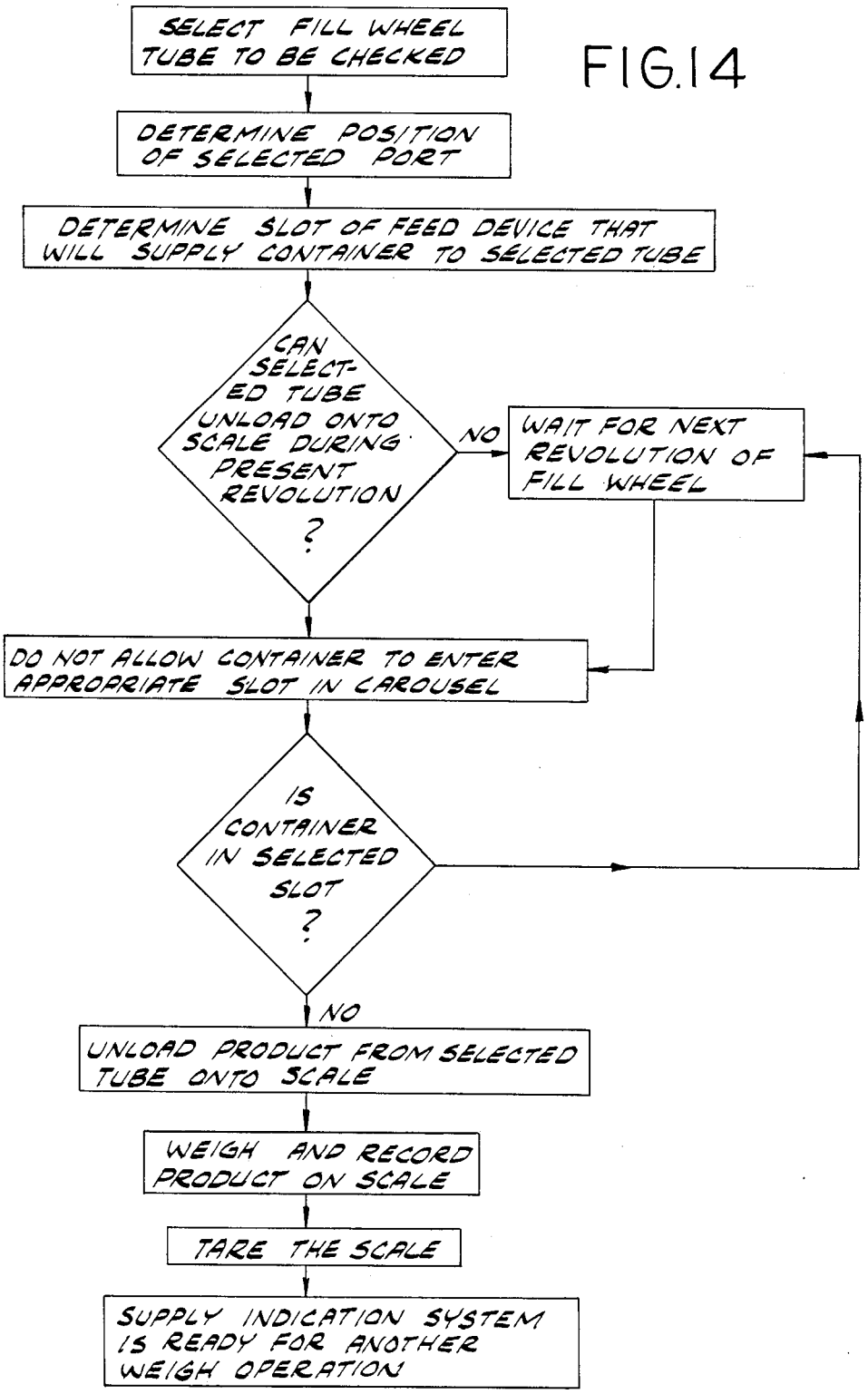
FIG. 14 is a flow diagram showing the general control logic of the microprocessor used in the control means of FIG. 13.

The control logic for the microprocessor 38 is shown generally in FIG. 14. A tube 14 to be checked is selected either manually or automatically according to a schedule so that over a predetermined period of time all of the tubes are checked. Once selected, the microprocessor determines the location of the tube relative to the position for unloading into the scale 34. This is achieved by the microprocessor constantly monitoring the rotational position of the wheel 12 through any well known means and comparing the current location to the known location for unloading into the scale. The microprocessor also determines the position of the slot 24 that will supply a container to the selected tube. This can also be done by constantly monitoring the rotation of the carousel and comparing the positions of the slots relative to the filling position F. A determination is then made by the microprocessor whether or not the selected tube can unload on the scale on this rotation or must wait until the next because it is too close to the unload position to prevent a container from entering the corresponding slot in the carousel.

If it is too close the microprocessor will not initiate the check-weigh procedure until the next revolution of the wheel. If it is not too close, the microprocessor will signal to close the gate 30 at the appropriate time to prevent a container from entering the slot of the carousel corresponding to the tube to be unloaded. Sensors (such as microswitches or the like) are preferably associated with each of the slots in the carousel so that the microprocessor can check to make sure that a container did not get positioned in the slot corresponding to the tube to be unloaded. It is especially important in the medical drug field to not have an empty container proceed through the filling line for safety reasons so that such a second check on the slot is often preferred. If this check indicates that in fact a container has entered the corresponding slot, the microprocessor simply holds off initiating the check-weigh until the next cycle in which it again prevents a container from entering the corresponding slot.

If the sensors indicate that there is no container in the corresponding slot, the microprocessor unloads the product from the selected tube onto the scale. The product is then weighed and the weight is stored in memory and, if desired, checked against a predetermined acceptable weight or weight range to see if it meets the standard. If the weight is just recorded, it can be later recalled by the operator to be sure it is an acceptable weight and if not, all of the containers filled since the last acceptable check-weigh can be removed and checked if desired. If the weight is automatically checked against a predetermined standard and found to be unacceptable, the microprocessor can be used to activate a signalling device to alert the operator.

In any event, after a check-weigh is completed the scale is re-tared with the unloaded product remaining on the scale so that the next tube to be unloaded can dump its product on top of the previously dumped product and a new weigh can be taken as though the scale were empty. After numerous check-weighs, the scale can be dumped in to the hopper for reprocessing of the product without any waste. Also, after the check-weigh is complete the microprocessor is reset so that the next check-weigh can be started.

Figure 5:
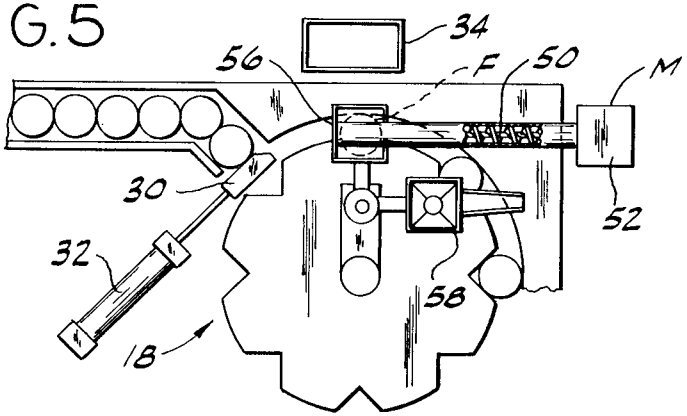
FIG. 5 is a plan view of a second preferred embodiment of the present invention.
Figure 8:
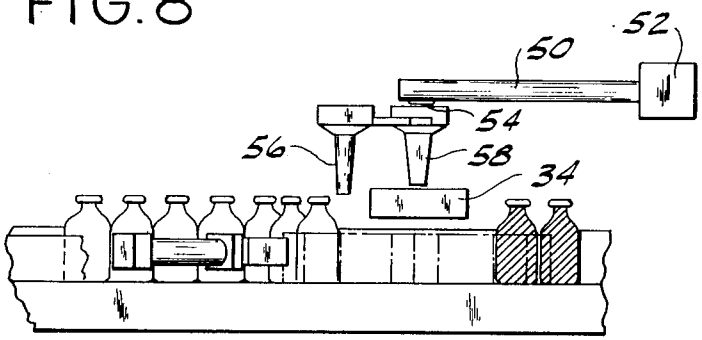
FIG. 8 is an elevational view of the embodiment of FIG. 7.
Figure 6:
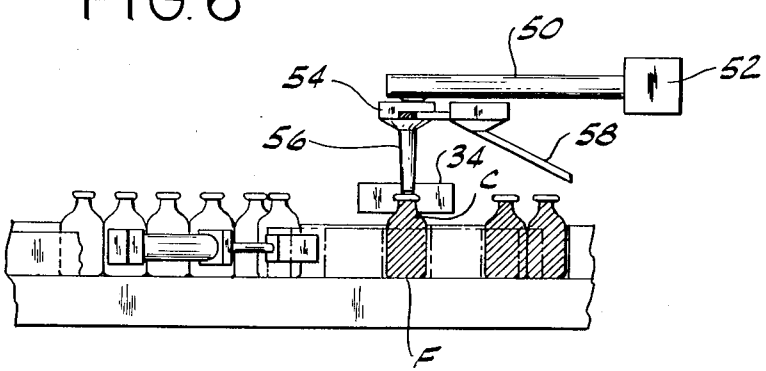
FIG. 6 is an elevational view of the embodiment of FIG. 5.

The first embodiment discussed above utilizes the turret wheel 12 for filling containers, however, many other methods are commonly used to fill such containers and are considered to be usable with the method and apparatus of the present invention. Some of these are discussed below as further alternative embodiments. In FIGS. 5–7 is shown a second embodiment in which an auger type feed arrangement is used. In this embodiment, the product is introduced to the filling position F by a rotating auger 50 which is rotated an exact number of turns or portion of a turn by a motor 52 to expel a precise amount of product from the opening 54 in the outer end of the auger into a funnel 56 which dumps it into a container brought into the filling position F by the carousel 18 as with the previous embodiment. Since, with the auger arrangement the product can not be dumped into a weigh scale 34 as easily as with the wheel 12, the funnel is mounted to be pivoted out from beneath the opening 54 and at the same time a second funnel 58 is swung into position beneath the opening 54 to direct the product to the check-weigh scale 34 positioned adjacent to the filling position F. As the auger is rotated the funnel 58 directs the product away from the filling position to the scale.

After a check-weigh has been taken, the first funnel 56 is rotated back into position to fill subsequent containers. As with the first embodiment, the container is prevented from entering the slot in the carousel 18 by the gate 30 operated by the microprocessor as before.

Figure 11:
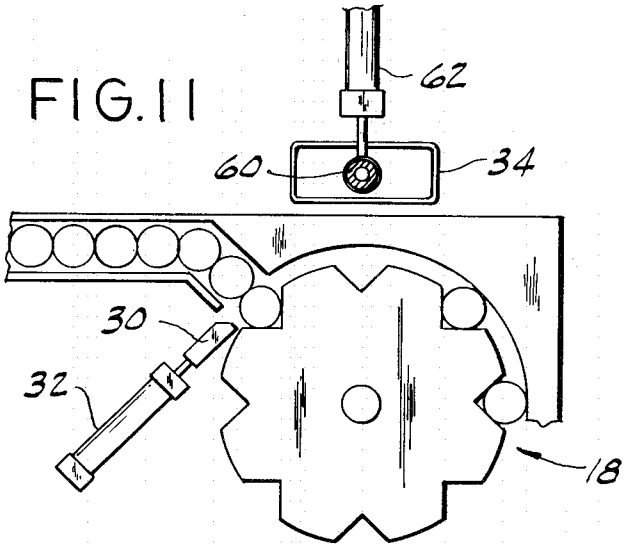
FIG. 11 is a plan view of a fifth alternative embodiment of the present invention.
Figure 12:
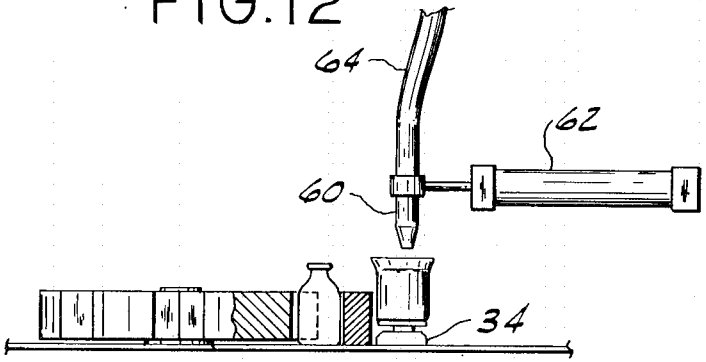
FIG. 12 is an elevational view of the embodiment of FIG. 11.
Figure 9:
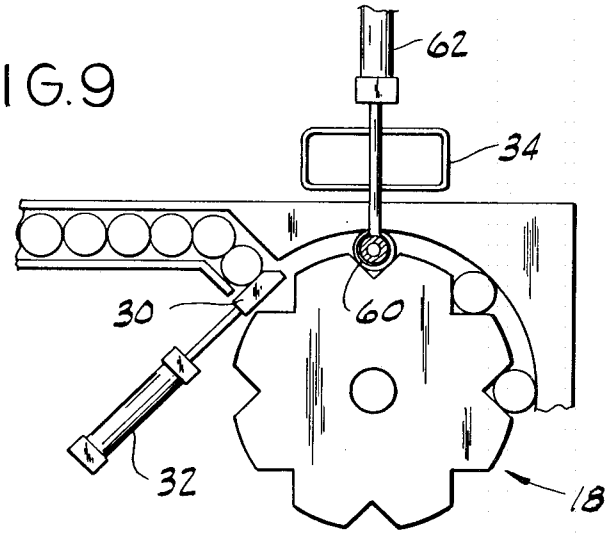
FIG. 9 is a plan view of a fourth alternative embodiment of the present invention.
Figure 10:
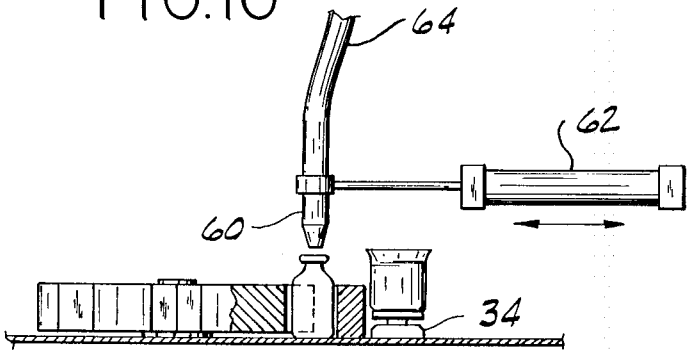
FIG. 10 is an elevational view of the embodiment of FIG. 9.

A third embodiment is contemplated which is especially suited for check-weighing liquids utilizing the method and apparatus of the present invention, as shown in FIGS. 9–12. In this embodiment a nozzle 60 is mounted on a double-acting air cylinder 62 and is attached to a flexible tubing 64 through which an exact product dosage in liquid can be supplied in any of several well known ways. The normal position for filling containers C is shown in FIGS. 9 and 10 where the nozzle is positioned over the filling position F to fill the containers C as they are passed under the nozzle 60 by the carousel 18 as in the previous embodiments. When a check-weigh is desired, the cylinder 62 is moved to the retracted position as shown in FIGS. 11 and 12 so that the nozzle is positioned over the scale 34. The charge of product is then released into the scale and weighed as before. When the check-weighing is done the container which otherwise would be positioned under the nozzle in the filling position F is withheld from the carousel 18 by the gate 30 as in the previously described embodiments. The microprocessor is used to control the check-weighing as described above in conjunction with the first described embodiment.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. The method of filling containers with measured charges of product, comprising:

feeding containers forward in series one after another through a filling zone for being filled with measured charges of product as they travel through the filling zone, with gaps at spaced intervals in the series where a container is omitted;

measuring charges of product including charges for the containers traveling through said filling zone and charges corresponding to the gaps;

delivering to said filling zone the charges for the containers traveling through said filling zone and filling each container with a charge as it travels through said zone;

diverting from the filling zone each charge corresponding to a gap;

delivering each diverted charge to a check weighing station; and comparing the weight of each diverted charge, at said check weighing station, with a reference weight to determine the acceptability or unacceptability of each said diverted charge; whereby, on the determination of the unacceptability of a diverted charge and the filling of a number of the containers following the determination of the acceptability of a diverted charge, the containers which were filled following the said determination of acceptability of the diverted charge may be retrieved.

2. The method of filling containers with measured charges of product and check weighing the filling, comprising:

feeding containers forward in series one after another through a filling zone for being filled with measured charges of product as they travel through the filling zone;

measuring charges of product for delivery thereof one after another in timed relation to the feeding of the containers;

delivering charges to the filling zone for the filling of the containers as they travel through the filling zone;

interrupting the delivery of charge at intervals for diverting a charge for check-weighing;

controlling said series of containers to have gaps therein corresponding to the diverted charges;

delivering each diverted charge to a check weighing station; and comparing the weight of each diverted charge, at said check weighing station, with a reference weight to determine the acceptability or unacceptability of each said diverted charge;

whereby, there is no unfilled container in the series traveling downstream from the filling zone; and whereby, on the determination of the unacceptability of a diverted charge and the filling of a number of the containers following the determination of the acceptability of a diverted charge, the containers which were filled following the said determination of acceptability of the diverted charge may be retrieved.

3. A method of check-weighing a measured charge of a product out of a series of such charges being supplied to a container filling station for filling a series of containers passing therethrough, comprising:

sequentially feeding the series of containers through the filling station with a predetermined spacing between each;

intermittently deleting a container from the series and retaining a space in the series where the container would otherwise be as the series passes through the filling station;

sequentially supplying the measured charges to the filling station in timed relation to the series of containers so that a charge is supplied to each container and a charge is also supplied to the filling station corresponding to the said space in said series;

removing from the filling station the charge which would otherwise be supplied to said space before it is supplied to said space; and delivering the removed charge to a weighing device and checking the weight against a predetermined acceptable weight standard while the filling station continues to fill subsequent containers with subsequent charges supplied thereto.

4. Apparatus for filling a sequential supply of containers with charges of product while intermittently checking the weight of selected charges, comprising:

conveyor means for conveying a sequential supply of containers in at least one row and in predetermined spaced relation;

container filling means disposed adjacent the conveyor means for delivering a measured charge of product to each container as the container is conveyed by said conveyor means past said container filling means;

product weighing means disposed adjacent the filling means for receiving therefrom a charge of product which otherwise would have been delivered to a container;

means upstream of the filling means for creating a space on the conveyor means at a location for a container corresponding to the charge weighed by the weighing means; and means for diverting to said weighing means the charge which otherwise would have been delivered to said space.

5. Apparatus as defined in claim 4 wherein the means for creating a space includes:

means for receiving containers from a supply thereof and positioning the containers in the predetermined relation; and means for withholding a container from the positioning means to produce a space where that container would otherwise have been positioned.

6. Apparatus as defined in claim 5 wherein the conveyor means includes a carousel having a plurality of slots defined therein each for receiving a container from a first location around its periphery and transporting it to a second location where it is filled by the filling means, and the means for creating a space includes means disposed at the first location for preventing a container from being received in a slot in the carousel.

7. Apparatus as defined in claim 6 including a feed conveyor for supplying containers one at a time to the first location and the means for preventing a container from being received in a slot includes a slide member extendable from a normally retracted position out of the path of the containers on the feed conveyor to a position across the feed conveyor to engage and stop a container from entering a slot in the carousel.

8. Apparatus as defined in claim 5 including means for both coordinating the product weighing means and the means for creating a space so that the space created reaches the container filling means at the time of delivery of the charge to be weighed and activating the weighing means and the space creating means at predetermined frequency.

9. Apparatus as defined in claim 8 wherein the coordinating means includes means for comparing the weight of a charge determined by the weighing means with a predetermined standard and providing an indication of whether or not the weight meets the standard.

10. Apparatus as defined in claim 9 wherein the coordinating means includes a microprocessor.

11. Apparatus as defined in claim 5 wherein the filling means includes means for delivering a sequential supply of dry powder charges to the containers and the weighing means includes a receptacle disposed adjacent the filling means for receiving a charge therefrom, the filling means being operable to deposit a charge on the receptacle instead of depositing it in the container.

12. Apparatus as defined in claim 11 wherein the filling means is disposed above the conveyor means and includes:

a plurality of charge receiving receptacles radially extending from a central axis about which they rotate in a vertical plane;

a feed hopper disposed above the receptacles for supplying product thereto;

means for retaining the charges of product in the receptacles as they rotate from the feed hopper to the containers and for discharging a preselected charge into the receptacle of the weighing means; and means for rotating the charge receiving receptacles about sequentially pass the feed hopper and deliver the charges to the containers.

13. Apparatus as defined in claim 12 wherein the filling means further includes an auger mounted for rotation within a tube extending over the containers on the conveyor means and having an opening therein for delivering measured amounts of product charge to containers, and the weighing means a receptacle and includes means for receiving a measured charge from the tube and delivering it to the receptacle.

14. Apparatus as defined in claim 13 wherein the means for receiving a measured charge includes a funnel movable between a first position removed from the opening in the tube and out of the way of containers passing by the filling means on the conveyor means and a second position disposed beneath the opening in the tube and directing the charge to the receptacle.

15. Apparatus as defined in claim 5 wherein the filling means includes means for delivering a liquid charge to the containers and is movable between a first position in which it is over the containers as they pass along the conveyor means for filling them and a second position over the weighing means for supplying a measured charge of the product to the weighing means.

* * * * *

UNITED STATES PATENT AND TRADEMARK OFFICE

CERTIFICATE OF CORRECTION

PATENT NO. : 4,715,412

DATED : December 29, 1987

INVENTOR(S) : Nicholas J. Perazzo

It is certified that error appears in the above—identified patent and that said Letters Patent is hereby corrected as shown below:

Column 7, line 32, change "charge" to --charges--. Column 9, claim 11, line 7, "the container" should read --a container--. Column 9, claim 12, line 22, "about sequentially" should read --about the axis to sequentially--. Column 10, claim 13, lines 6-7, "means a receptacle and includes means" should read --means includes a receptacle and means--.

Signed and Sealed this

Twenty-fifth Day of October, 1988

*Attest:*

DONALD J. QUIGG

*Attesting Officer*

*Commissioner of Patents and Trademarks*